US005273854A

United States Patent [19]

Shinozuka et al.

[11] Patent Number: 5,273,854

[45] Date of Patent: Dec. 28, 1993

[54] LIQUID COMPOSITION FOR DEVELOPING ELECTROPHOTOGRAPHY AND PROCESS FOR PRODUCING THE SAME

[75] Inventors: Masakazu Shinozuka; Yoshiyuki Ozawa, both of Suwa, Japan

[73] Assignee: Seiko Epson Corporation, Tokyo, Japan

[21] Appl. No.: 851,992

[22] Filed: Mar. 13, 1992

[30] Foreign Application Priority Data

Mar. 19, 1991 [JP] Japan ..... 3-054571
Nov. 27, 1991 [JP] Japan ..... 3-312430

[51] Int. Cl.[5] ..... G03G 9/13
[52] U.S. Cl. ..... 430/114; 430/137
[58] Field of Search ..... 430/137, 114, 115

[56] References Cited

U.S. PATENT DOCUMENTS 3,770,637 11/1973 Okuno ..... 252/62.1
3,993,483 11/1976 Maki ..... 96/1
5,047,307 9/1991 Lawda et al. ..... 430/137

FOREIGN PATENT DOCUMENTS 0450417 10/1991 European Pat. Off. .
3619078 12/1986 Fed. Rep. of Germany .
2192329 3/1974 France .

*Primary Examiner*—John Goodrow
*Attorney, Agent, or Firm*—Ladas & Parry

[57] ABSTRACT

A liquid composition for developing electrophotography, comprising a toner which comprises a pigment coated with a rosin or its derivative and an ethylene copolymer, and a carrier liquid having a high insulation and low dielectric constant, the toner being dispersed in the carrier liquid. The liquid composition for developing electrophotography according to the present invention provides a toner image having a sufficient density and a clear contour on a recording paper by means of a low pressure in an intermediate transfer system.

13 Claims, 1 Drawing Sheet

LIQUID COMPOSITION FOR DEVELOPING ELECTROPHOTOGRAPHY AND PROCESS FOR PRODUCING THE SAME

BACKGROUND OF THE INVENTION

Field of the Invention

The present invention relates to a liquid developer for a recording apparatus using a wet development process in an electrophotographic system, such as a copying machine and a printer, and particularly to a liquid developer which can provide a toner image having a sufficient density and a clear contour on a recording paper by means of a low pressure particularly in a recording apparatus of an intermediate transfer system.

Description of the Related Art

A liquid developer for developing electrophotography known in the art comprises a toner composed mainly of a thermoplastic resin, such as a styrene resin or an acrylic resin, and a pigment or a dye, such as carbon black, dispersed in a carrier liquid such as a petroleum aliphatic hydrocarbon solvent (for example, Japanese Patent Laid-Open Publication No. 35321/1980). Further, in order to obtain a higher resolution, a proposal has been made on a developing agent wherein an ethylene copolymer resin which becomes compatible with a nonpolar solvent upon being heated is used (U.S. Pat. Nos. 4794651 and 4842974 and Japanese Patent Laid-Open Publication No. 189248/1986).

These liquid developers, however, have a variation in the adsorption of a resin and a charge control agent on a pigment, and the variation often makes it difficult to stabilize developing properties. Further, particularly in the case of carbon black, since it has an electrical conductivity as opposed to many of other organic pigments, there occurred a difference in the developing properties between black and other colors in the case of full color recording. It is difficult to adjust the difference.

Recording with these liquid developers and a recording apparatus using an intermediate transfer system had drawbacks that no image having a sufficient density can be formed on a recording paper due to a poor transfer efficiency and no image having a clear contour can be formed. The term "intermediate transfer system" in this disclosure is intended to mean a method which comprises the steps of forming an electrostatic latent image on a photoreceptor, developing the latent image with a liquid developer, transferring the developed image on an intermediate transfer belt or drum and further transferring the toner image on a recording paper (for example, U.S. Pat. No. 4708460). In the intermediate transfer system, the transfer of the toner image from the intermediate transfer belt to the recording paper is conducted while applying a pressure to the intermediate transfer belt and the recording paper. In order to sufficiently deposit the toner image on a recording paper, it is necessary to increase the pressure. However, there is a limitation on the pressure which can be applied in an actual apparatus, so that no sufficient adhesive force cannot be obtained, which causes the transfer efficiency to be lowered.

SUMMARY OF THE INVENTION

Accordingly, an object of the present invention is to provide a liquid developer for a recording apparatus using a wet development process in an electrophotographic system, such as a copying machine and a printer, and a process for producing the same.

A further object of the present invention is to provide a liquid developer capable of providing a toner image having a sufficient density and a clear contour on a recording paper by means of a low pressure in a recording apparatus of an intermediate transfer system, and a process for producing the same.

According to an aspect of the present invention, there is provided a liquid composition for developing electrophotography, comprising: a toner which comprises a pigment coated with a rosin or its derivative and an ethylene copolymer, and a carrier liquid having a high insulation and low dielectric constant, the toner being dispersed in the carrier liquid.

According to another aspect of the present invention, there is provided a process for producing a liquid composition for developing electrophotography, comprising the steps of: preparing a mixture including an ethylene copolymer and a carrier liquid having a high insulation and low dielectric constant, heating the mixture to dissolve the ethylene copolymer in the carrier liquid, adding a pigment coated with a rosin or its derivative to the mixture, and dispersing the pigment in the mixture.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein.

DETAILED DESCRIPTION OF THE INVENTION

Figure 1:
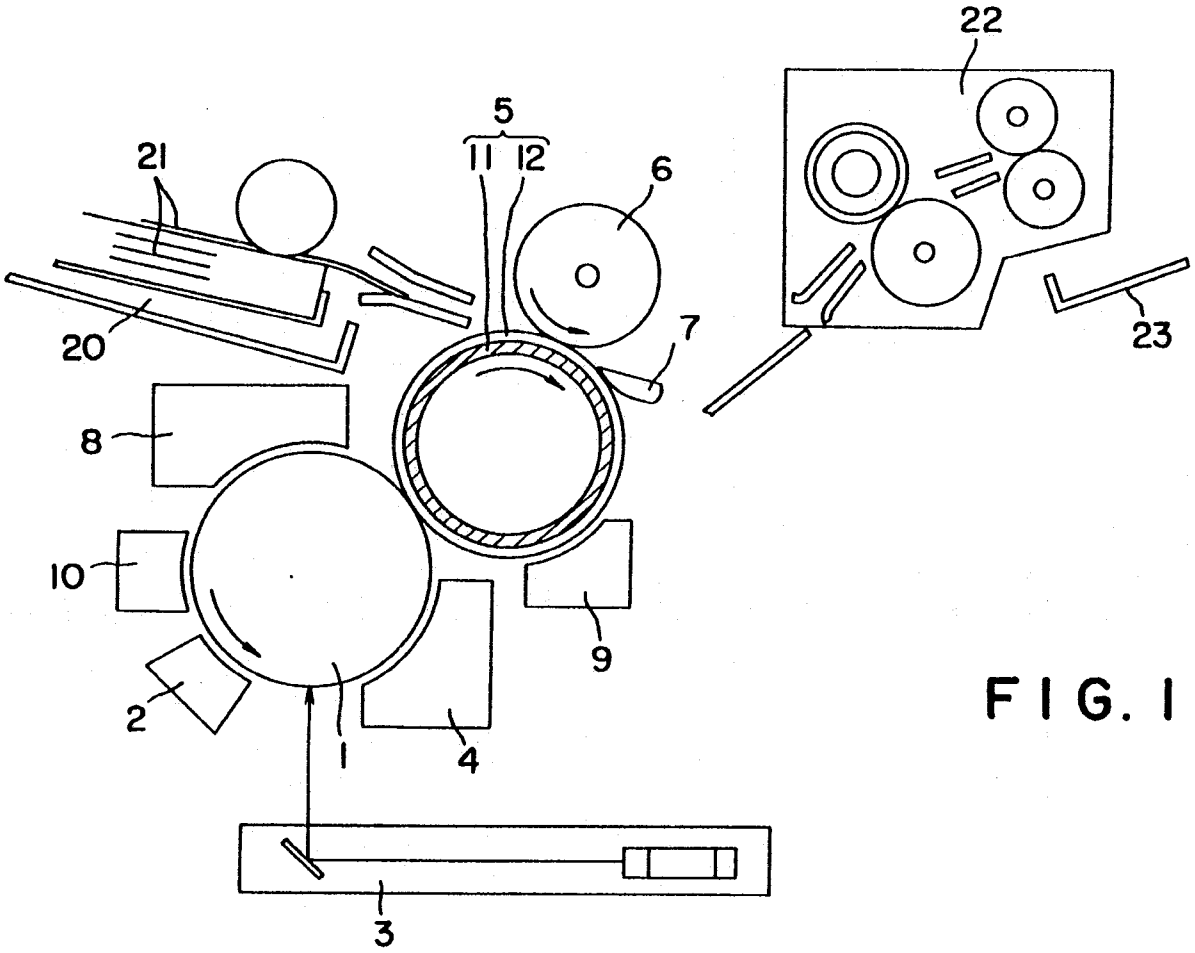
FIG. 1 is a cross-sectional view of a recording apparatus by means of the liquid composition for developing electrophotography according to the present invention.

The liquid developer of the present invention comprises toner particles which comprise (i) a colorant and (ii) a resin for serving as a fixing agent and imparting an electric charge to the toner particles, and a carrier liquid having a high insulation and a low dielectric constant (hereinafter referred to as "carrier liquid"), wherein the toner particles are dispersed in the carrier liquid. According to the present invention, the toner particles dispersed in the carrier liquid comprises, as the colorant, a pigment coated with a rosin or its derivatives and, as the resin, an ethylene copolymer.

In the present invention, both the rosin or its rosin covering the surface of the pigment and the ethylene copolymer take such a structure that the ethylene copolymer is adsorbed and/or deposited on the surface of the rosin or its derivative. The expression "adsorbed and/or deposited" in this disclosure is intended to mean such a state that the rosin or its derivative and the ethylene copolymer are microscopically bonded to each other in a physical manner through a hydrogen bond or the like and the surface of the rosin or its derivative is macroscopically coated with the ethylene copolymer resin. The interface of the rosin or its derivative and the ethylene copolymer is not necessary to be observed macroscopically and may be a compatible portion wherein the rosin or its derivative and the ethylene copolymer are mixed with each other, and the presence of such a compatible portion is advantageous in the present invention.

In order to realize the toner particle structure, it is necessary to select a carrier liquid which is capable of hardly dissolving or sparingly dissolving a rosin or its derivative and becomes compatible with an ethylene copolymer upon being dissolved through heating. Furthermore, it is necessary to select such a combination of a rosin or its derivative with an ethylene copolymer that they are completely compatible with each other at room temperature.

In the present invention, the rosin is a resin composed mainly of abietic acid, and the derivative of the rosin is a product obtained by subjecting the rosin to hydrogenation, esterification, polymerization or the like. Preferred examples of the derivative include gum rosin, wood rosin, rosin glycerine ester, rosin pentaerythritol ester, partially hydrogenated rosin, completely hydrogenated rosin, partially hydrogenated rosin methyl ester, partially hydrogenated rosin triethylene glycol ester, partially hydrogenated rosin glycerine ester, partially hydrogenated rosin pentaerythritol ester, completely hydrogenated rosin glycerine ester, completely hydrogenated rosin pentaerythritol ester, rosin alcohol, maleic-acid-modified rosin, maleic-acid-modified rosin ester, rosin-modified phenol, polymerized rosin and polymerized rosin ester.

The pigment coated with a rosin or its derivative can be produced by dissolving a rosin or its derivative in a solvent capable of sufficiently dissolving the rosin or its derivative, such as a ketone, an ester or toluene, adding a desired pigment to the solution, dispersing the pigment in the solution by means of a dispersing machine, such as an attritor or a ball mill, and distilling off the solvent. Furthermore, it is also possible to prepare the pigment coated with a rosin or its derivative by flushing dispersion. The weight ratio of the pigment to the rosin or its derivative is preferably 1:0.1 to 1:1, still preferably 1:0.2 to 1:0.5.

It is also possible to use a commercially available pigment coated with a rosin ester, and examples thereof include Microlith Yellow 2G-T, Microlith Yellow 3R-T, Microlith Brown 5R-T, Microlith Scarlet R-T, Microlith Red BR-T, Microlith Blue GS-T, Microlith Blue 4G-T, Microlith Green G-T and Microlith Black C-T (all the above products being available from Ciba-Geigy Limited).

According to a preferred embodiment of the present invention, examples of the ethylene copolymer include an ethylene-vinyl acetate copolymer resin and an ethylene-ethyl acrylate copolymer resin. It is particularly preferred for the ethylene copolymer to have a melt index (MI) of 10 or more and a polar group content of 10% by weight or more. When the MI value is less than 10, the dispersion stability of the toner particle is often unfavorably poor. When the polar group content is less than 10% by weight, the amount of electrification as the toner particle often unfavorably becomes insufficient. Preferred examples of the ethylene-vinyl acetate copolymer having a MI value of 10 or more and a polar group content of 10% by weight or more include NUC-3140, NUC-3140BK, NUC-3145, NUC-3460, DQDJ-3868, NUC-3150, NUC-3160, NUC-3190, DQDJ-3269, NUC-3165, NUC-3170, DQDJ-7179, NUC-3185, MB-010, MB-030, MB-600, MB-850, MB-990 and MB-080 (all the above products being available from Nippon Unicar Co., Ltd.), and Evaflex EV45X, EV40, EV40X, V577-2, EV-150, V523, EV-210, V541, EV220, V542, EV220NC, EV250, EV250SS, EV250C, EV310, V577, EV410, EV420, EV450, EV550, P1407C, P1207, P1207C and EV640 (all the above products being available from Du Pont-Mitsui Polychemicals Co., Ltd.).

Examples of the ethylene-ethyl acrylate copolymer resin having an MI value of 10 or more and a polar group content of 10% by weight or more include DPDJ-9169, NUC-6070, MB-730, MB-870, MB-900 and MB-910 (all the above products being available from Nippon Unicar Co., Ltd.) and Evaflex A-704, A-706, A-707 and A-709 (all the above products being available from Du Pont-Mitsui Polychemicals Co., Ltd.).

With respect to the carrier liquid having a high insulation and a low dielectric constant, the conventional carrier liquid used in the conventional liquid developer for electrophotography, as such, may be used. It is preferred for the carrier liquid to have a high insulation of $10^{13}$ Ω·cm or more and a low dielectric constant of 3 or less. Preferred examples of the carrier liquid include aliphatic hydrocarbon solvents, such as Exxol and Isoper (all the above products being available from Exxon Chemical Limited), IP Solvent (available from Idemitsu Petrochemical Co., Ltd.) and Shellsol (available from Shell Industrial Chemicals Co., Ltd.).

If necessary, it is also possible to use as a third component an additive, such as a charge control agent, for the purpose of improving various properties of the developing agent.

The liquid developer of the present invention can be produced as follows. At the outset, an ethylene copolymer is added to the carrier liquid having a high insulation and a low dielectric constant, and the mixture is heated to dissolve the copolymer in the carrier liquid. The pigment coated with a rosin or its derivative is added and mixed with the resultant solution. The addition of the pigment coated with a rosin or its derivative may be conducted with the heated solution of the ethylene copolymer in the carrier liquid being in a hot state or after the heated solution is cooled. The amount of addition of the ethylene copolymer is preferably 0.01 to 10 parts by weight, still preferably 0.1 to 4 parts by weight based on 1 part of the pigment coated with a rosin or its derivative. The heating temperature for dissolution may be such that the ethylene copolymer resin can be homogeneously dissolved in the carrier liquid. More specifically, the heating temperature is preferably about 80° to 200° C., still preferably about 100° to 170° C. A homogeneously gelatinized concentrate can be prepared by stirring the mixture containing a pigment coated with a rosin or its derivative by a suitable means. The concentrate is subjected to dispersion by means of a conventional dispersing means, for example, a ball mill, an attritor, a bead mill, etc. to give a toner particle having a desired particle diameter. Although the size of the toner particle may be properly determined depending upon the service conditions of the toner particle, it is preferably about 0.1 to 5 μm. After the dispersion, the concentrate can be further diluted with the carrier liquid to a suitable concentration for use as a liquid developer. When the dispersing method used has an appropriate viscous region for dispersing, it is possible to dilute the concentrate with the carrier liquid prior to the step of dispersion.

The liquid developer according to the present invention is applicable to a developing device of an electrophotographic system using a conventional wet development process. The developer according to the present invention can realize a transfer efficiency superior to that of the conventional liquid developer. The developer of the present invention can increase the transfer efficiency to about 90% from about 70% which is the highest transfer efficiency of the conventional liquid developer. In particular, when the developer of the present invention is used in the intermediate transfer system, it becomes possible to form a toner image having a sufficient density and a clear image on a recording paper even under a low pressure by virtue of the high transfer efficiency of the developer.

EXAMPLES

The present invention will now be described in more detail with reference to the following examples, though it is not limited to these examples only.

EXAMPLE 1

To 100 g of Isoper G (an aliphatic hydrocarbon solvent manufactured by Exxon Chemical Limited) was added 10 g of MB-870 (an ethylene-ethyl acrylate copolymer resin manufactured by Nippon Unicar Co., Ltd., MI: 20, polar group content: 41%), and the mixture was heated at 150° C. in a container equipped with a reflux condenser and a stirrer to dissolve the copolymer resin in the solvent. After the resultant solution was cooled, 10 g of Microlith Black C-T (a pigment coated with a rosin ester manufactured by Ciba-Geigy Limited), 0.2 g of lecithin (a charge control agent) and 79.8 g of Isoper G were added thereto, and the mixture was subjected to dispersion by means of an attritor for 5 hr to give 200 g of a concentrate. The concentrate was diluted with 800 g of Isoper G to give a liquid developer for electrophotography.

COMPARATIVE EXAMPLE 1

A liquid developer for electrophotography was prepared in the same manner as that of Example 1, except that Carbon Black #44 (manufactured by Mitsubishi Chemical Industries, Ltd.) was used instead of Microlith Black C-T.

EXAMPLE 2

To 100 g of IP Solvent 1620 (an aliphatic hydrocarbon solvent manufactured by Idemitsu Petrochemical Co., Ltd.) was added 5 g of Evaflex EV-410 (an ethylene-vinyl acetate copolymer resin manufactured by Du Pont-Mitsui Polychemicals Co., Ltd., MI: 400, polar group content: 19%), and the mixture was heated at 150° C. in a container equipped with a reflux condenser and a stirrer to dissolve the copolymer resin in the solvent. After the resultant solution was cooled, 15 g of Microlith Yellow 2G-T (a pigment coated with a rosin ester manufactured by Ciba-Geigy Limited), 0.3 g of lecithin (a charge control agent) and 79.7 g of IP Solvent 1620 were added thereto, and the mixture was subjected to dispersion by means of an attritor for 4 hr to give 200 g of a concentrate. The concentrate was diluted with 800 g of IP Solvent 1620 to give a liquid developer for electrophotography.

COMPARATIVE EXAMPLE 2

A liquid developer for electrophotography was prepared in the same manner as that of Example 2, except that Benzidine Yellow was used instead of Microlith Yellow 2G-T.

EXAMPLE 3

To 100 g of Shellsol 70L (an aliphatic hydrocarbon solvent manufactured by Shell Industrial Chemicals Co., Ltd.) were added 5 g of Evaflex EV-450 (an ethylene vinyl acetate copolymer resin manufactured by Du Pont-Mitsui Polychemicals Co., Ltd., MI: 15, polar group content: 19%) and 15 g of MB-900 (an ethylene/ethyl acrylate copolymer resin manufactured by Nippon Unicar Co., Ltd., MI: 1500, polar group content: 23%), and the mixture was heated at 150° C. in a container equipped with a reflux condenser and a stirrer to dissolve the copolymer resin in the solvent. After the resultant solution was cooled, 7 g of Microlith Red BR-T (a pigment coated with a rosin ester manufactured by Ciba-Geigy Limited), 0.14 g of lecithin (a charge control agent) and 72.86 g of Shellsol 70L were added thereto, and the mixture was subjected to dispersion by means of an attritor for 4 hr to give 200 g of a concentrate. The concentrate was diluted with 800 g of Shellsol 70L to give a liquid developer for electrophotography.

COMPARATIVE EXAMPLE 3

A liquid developer for electrophotography was prepared in the same manner as that of Example 3, except that Brilliant Carmine 6B was used instead of Microlith Red BR-T.

EXAMPLE 4

To 100 g of Isoper H (an aliphatic hydrocarbon solvent manufactured by Exxon Chemical Limited) was added 10 g of Evaflex A-709 (an ethylene-ethyl acrylate copolymer resin manufactured by Du Pont-Mitsui Polychemicals Co., Ltd., MI: 25, polar group content: 35%), and the mixture was heated at 150° C. in a container equipped with a reflux condenser and a stirrer to dissolve the copolymer resin in the solvent. After the resultant solution was cooled, 10 g of Microlith Blue 4G-T (a pigment coated with a rosin ester manufactured by Ciba-Geigy Limited), 0.2 g of lecithin and 79.8 g of Isoper H was added thereto, and the mixture was subjected to dispersion by means of an attritor for 4 hr to give 200 g of a concentrate. The concentrate was diluted with 800 g of Isoper H to give a liquid developer for electrophotography.

COMPARATIVE EXAMPLE 4

A liquid developer for electrophotography was prepared in the same manner as that of Example 4, except that Evaflex A-701 (an ethylene-ethyl acrylate copolymer resin manufactured by Du Pont-Mitsui Polychemicals Co., Ltd., MI: 5, polar group content: 9%) was used instead of A-709.

EXAMPLE 5

To 100 g of Isoper G (an aliphatic hydrocarbon solvent manufactured by Exxon Chemical Limited) was added 3 g of NUC-3185 (an ethylene-vinyl acetate copolymer resin manufactured by Nippon Unicar Co., Ltd., MI: 400, polar group content: 28%), and the mixture was heated at 150° C. in a container equipped with a reflux condenser and a stirrer to dissolve the copolymer resin in the solvent. After the resultant solution was cooled, 10 g of composite comprising Ket Yellow 402 (C.I. Pigment Yellow 154 manufactured by Dainippon Ink and Chemicals, Inc.) coated with Staybelite Ester 7 (a partially hydrogenated rosin glycerine ester manufactured by Rika Hercules Inc.) (weight ratio 1:0.3), 0.2 g of Sansepara 100 (sodium dioctylsulfosuccinate manufactured by Sanyo Chemical ( Industry Ltd.) and 86.8 g of Isoper G were added thereto, and the mixture was subjected to dispersion by means of Eiger Motor Mill (a bead mill manufactured by Eiger Engineering Limited) for 20 min to give 200 g of a concentrate. The concentrate was diluted with 800 g of Isoper G to give a liquid developer for electrophotography.

COMPARATIVE EXAMPLE 5

A liquid developer was prepared in the same manner as that of Example 5, except that Ket Yellow 402 (C.I. Pigment Yellow 154 manufactured by Dainippon Ink and Chemicals, Inc.) subjected to no coating treatment was used instead of the pigment coated with Staybelite Ester 7.

EXAMPLE 6

To 100 g of Isoper G (an aliphatic hydrocarbon solvent manufactured by Exxon Chemical Limited) was added 5 g of MB-910 (an ethylene-ethyl acrylate copolymer resin manufactured by Nippon Unicar Co., Ltd., MI: 1100, polar group content: 28%), and the mixture was heated at 120° C. in a container equipped with a reflux condenser and a stirrer to dissolve the copolymer resin in the solvent. After the resultant solution was cooled, 10 g of a composite comprising Ket Red 308 (C.I. Pigment Red 31 manufactured by Dainippon Ink and Chemicals, Inc.) coated with Pentalyn A-JA (a rosin pentaerythritol ester manufactured by Rika Hercules Inc.) (weight ratio 1:0.3), 0.2 g of Sansepara 100 (sodium dioctylsulfosuccinate manufactured by Sanyo Chemical Industry Ltd.) and 84.8 g of Isoper G were added thereto, and the mixture was subjected to dispersion by means of Eiger Motor Mill (a bead mill manufactured by Eiger Engineering Limited) for 20 min to give 200 g of a concentrate. The concentrate was diluted with 800 g of Isoper G to give a liquid developer for electrophotography.

COMPARATIVE EXAMPLE 6

A liquid developer was prepared in the same manner as that of Example 6, except that Ket Red 308 (C.I. Pigment Red 31 manufactured by Dainippon Ink and Chemicals, Inc.) subjected to no coating treatment was used instead of the pigment coated with Pentalyn A-JA.

EXAMPLE 7

To 100 g of Isoper G (an aliphatic hydrocarbon solvent manufactured by Exxon Chemical Limited) was added 2 g of MB-850 (an ethylene-vinyl acetate copolymer resin by Nippon Unicar Co., Ltd., MI: 800, polar group content: 22%), and the mixture was heated at 130° C. in a container equipped with a reflux condenser and a stirrer to dissolve the copolymer resin in the solvent. After the resultant solution was cooled, 10 g of a composite comprising Ket Blue 118 (C.I. Pigment Blue 15 manufactured by Dainippon Ink and Chemicals, Inc.) coated with Pentalyn 4820 (a maleic-acid-modified rosin ester manufactured by Rika Hercules Inc.) (weight ratio 1:0.3), 0.2 g of Sansepara 100 (sodium dioctylsulfosuccinate manufactured by Sanyo Chemical Industry Ltd.), 0.1 g of lecithin and 87.7 g of Isoper G were added thereto, and the mixture was subjected to dispersion by means of Eiger Motor Mill (a bead mill manufactured by Eiger Engineering Limited) for 20 min to give 200 g of a concentrate. The concentrate was diluted with 800 g of Isoper G to give a liquid developer for electrophotography.

COMPARATIVE EXAMPLE 7

A liquid developer was prepared in the same manner as that of Example 7, except that Ket Blue 118 (C.I. Pigment Blue 15 manufactured by Dainippon Ink and Chemicals, Inc.) subjected to no coating treatment was used instead of the pigment coated with Pentalyn 4820.

EXAMPLE 8

To 100 g of Isoper G (an aliphatic hydrocarbon solvent manufactured by Exxon Chemical Limited) was added 7 g of Evaflex V577-2 (an ethylene-vinyl acetate copolymer resin manufactured by Du Pont-Mitsui Polychemicals Co., Ltd., MI: 400, polar group content: 33%), and the mixture was heated at 120° C. in a container equipped with a reflux condenser and a stirrer to dissolve the copolymer resin in the solvent. After the resultant solution was cooled, 10 g of a composite comprising Carbon Black #10B (manufactured by Mitsubishi Chemical Industries, Ltd.) coated with Tamanol 135 (a rosin-modified phenol manufactured by Arakawa Chemical Industries Ltd.) (weight ratio 1:0.3), 0.2 g of Sansepara 100 (sodium dioctylsulfosuccinate manufactured by Sanyo Chemical Industry Ltd.), and 82.8 g of Isoper G were added thereto, and the mixture was subjected to dispersion by means of Eiger Motor Mill (a bead mill manufactured by Eiger Engineering Limited) for 20 min to give 200 g of a concentrate. The concentrate was diluted with 800 g of Isoper G to give a liquid developer for electrophotography.

COMPARATIVE EXAMPLE 8

A liquid developer was prepared in the same manner as that of Example 8, except that Carbon Black #10B (manufactured by Mitsubishi Chemical Industries, Ltd.) subjected to no coating treatment was used instead of the pigment coated with Tamanol 135.

DEVELOPING TEST

Recording was conducted on various types of recording papers through the use of liquid developer prepared in Examples 1 to 8 and Comparative Examples 1 to 8 according to a method described in Japanese Patent Laid-Open Publication Nos. 154085/1991 and 264280/1990.

FIG. 1 is a cross-sectional view of a recording apparatus for use in recording with the liquid developer for electrophotography according to the present invention. An electrifier 2, an exposing device 3, a developing device 4, an intermediate transfer drum 5, a pressure roller 6, a peeling claw 7, a cleaning device 8 and a de-electrifier 10 are successively provided around a photoreceptor drum 1. The intermediate transfer drum 5 comprises a metal hollow drum 11 and an elastic layer 12 covering the metal hollow drum 11. It is preferred for the elastic layer 12 to have a capability of absorbing the carrier liquid. Such an elastic layer can be prepared through the use of a silicone rubber. The intermediate transfer drum 5 is provided with a cleaning device 9 for removing a residual toner remaining untransferred.

The recording operation is conducted as follows. An electrostatic latent image is formed on the photoreceptor drum 1 through the steps of electrification and exposure. The electrostatic latent image is developed with a liquid developer in the developing device 4. The development is conducted by selectively depositing an electrified toner on the electrostatic latent image. Thus, a toner image is formed on the photoreceptor 1. Then, the intermediate transfer drum 5 is allowed to abut on the photoreceptor drum 5, and an electric field is applied thereto to transfer the toner image on the intermediate transfer drum 5. Separately, a recording paper 21 as a recording medium is carried out from a feeder 20 and carried to a position where the recording paper is allowed to abut on the intermediate transfer drum 5. A pressure is applied by means of a pressure roller 6. This causes the toner image on the intermediate transfer drum 5 to be deposited and transferred on the recording paper 21. The recording paper 21 having a transferred image is further carried to a fixation device 22 for thermal fixing under pressure, and then housed in a delivery tray 23.

Bit image recording and character recording were conducted on plain wood free paper, bond paper and PPC sheet according to the above recording method. As a result, it was confirmed that the liquid developer according to the present invention could provide better recording independently of the kinds of the recording paper as compared with the developer of the comparative examples. The reflection density of the images were measured by means of a Macbeth densitometer (model TR-927). The results are given in Table 1.

TABLE 1

| Example | | Comparative Example | |
|---|---|---|---|
| No. | OD value | No. | OD value |
| 1 | 1.54 | 1 | 1.42 |
| 2 | 1.45 | 2 | 1.37 |
| 3 | 1.40 | 3 | 1.33 |
| 4 | 1.48 | 4 | 1.40 |
| 5 | 1.43 | 5 | 1.38 |
| 6 | 1.44 | 6 | 1.40 |
| 7 | 1.50 | 7 | 1.40 |
| 8 | 1.53 | 8 | 1.43 |

What is claimed is:

1. A liquid composition for use in developing an electrostatic latent image on a photoreceptor such that the latent image so developed can be transferred to an intermediate transfer member and then to a recording medium with the use of pressure, the composition comprising:

a toner which comprises a pigment coated with a rosin or its derivative and an ethylene copolymer, and a carrier liquid having a high insulation and low dielectric constant, the toner being dispersed in the carrier liquid with the ethylene copolymer adsorbed to or deposited on the rosin such that the composition can be used to develop the electrostatic latent image on the photoreceptor to enable an efficient transfer of the developed image to the recording medium by way of said intermediate transfer member with tolerable pressure.

2. A liquid composition according to claim 1, wherein said ethylene copolymer is an ethylene-vinyl acetate copolymer and/or an ethylene-ethyl acrylate copolymer having a melt index of 10 or more and a polar group content of 10% by weight or more.

3. A process for producing a liquid composition for developing electrophotography, comprising the steps of:

preparing a mixture including an ethylene copolymer and a carrier liquid having a high insulation and low dielectric constant, heating the mixture to dissolve the ethylene copolymer in the carrier liquid, adding a pigment coated with a rosin or its derivative to the mixture, and dispersing the pigment in the mixture.

4. A process for producing a liquid composition according to claim 3, further comprising the step of cooling the mixture after the step of heating the mixture and before the step of adding the pigment to the mixture.

5. A process for producing a liquid composition according to claim 3, wherein the ethylene copolymer is an ethylene-vinyl acetate copolymer and/or an ethylene-ethyl acrylate copolymer having a melt index of 10 or more and a polar group content of 10% by weight or more.

6. A process for producing a liquid composition according to claim 3, wherein the ethylene copolymer is used in an amount of 0.01 to 10 parts by weight based on 1 part by weight of the pigment.

7. A liquid composition according to claim 1, wherein the rosin derivative is selected from the group consisting gum rosin, wood rosin, rosin glycerine ester, rosin pentaerythritol ester, partially hydrogenated rosin, hydrogenated rosin, hydrogenated rosin methyl ester, hydrogenated rosin triethylene glycol ester, hydrogenated rosin glycerine ester, hydrogenated rosin pentaerythritol ester, rosin alcohol, maleic-acid-modified rosin, maleic-acid-modified rosin ester, rosin-modified phenol, polymerized rosin and polymerized resin ester.

8. A liquid composition according to claim 1, wherein the carrier liquid has a high insulation of $10^{13}$ Ωcm or more and a low dielectric constant of 3 or less.

9. A process for developing an electrostatic latent image, comprising the steps of:

forming an electrostatic latent image on a photoreceptor, developing the latent image with a liquid developer, transferring the developed image on an intermediate transfer member, and transferring the developed image on a recording medium, said liquid developer comprising a toner which comprises an ethylene copolymer and a pigment coated with a rosin or its derivative , and a carrier liquid having a high insulation and low dielectric constant, the toner being dispersed in the carrier liquid.

10. A process according to claim 9, wherein the ethylene copolymer is an ethylene-vinyl acetate copolymer and/or an ethylene-ethyl acrylate copolymer having a melt index of 10 or more and a polar group content of 10% by weight or more.

11. A process according to claim 9, wherein the rosin derivative is selected from the group consisting of gum rosin, wood rosin, rosin glycerine ester, rosin pentaerythritol ester, partially hydrogenated rosin, hydrogenated rosin, hydrogenated rosin methyl ester, hydrogenated rosin triethylene glycol ester, hydrogenated rosin glycerine ester, hydrogenated rosin pentaerythritol ester, rosin alcohol, maleic-acid-modified rosin, maleic-acid-modified rosin ester, rosin-modified phenol, polymerized rosin and polymerized rosin ester.

12. A process according to claim 9, wherein the carrier liquid has a high insulation of $10^{13}$ Ωcm or more and a low dielectric constant of 3 or less.

13. A process according to claim 9, wherein the photoreceptor and the intermediate transfer member are drums which are positioned adjacent each other.

* * * * *